US005556436A

United States Patent [19]

Yagaki et al.

[11] Patent Number: 5,556,436

[45] Date of Patent: Sep. 17, 1996

[54] SOLID FUEL MADE FROM POROUS COAL AND PRODUCTION PROCESS AND PRODUCTION APPARATUS THEREFORE

[75] Inventors: Kazuhito Yagaki; Osamu Okuma; Takuo Shigehisa; Tetsuya Deguchi, all of Kobe, Japan

[73] Assignee: Kabushiki Kaisha Kobe Seiko Sho, Kobe, Japan

[21] Appl. No.: 364,753

[22] Filed: Dec. 27, 1994

[30] Foreign Application Priority Data

Dec. 27, 1993 [JP] Japan ..... 5-331729

[51] Int. Cl.[6] ..... C10L 1/32; C10L 9/00

[52] U.S. Cl. ..... 44/626; 44/282

[58] Field of Search ..... 44/626, 282

[56] References Cited

U.S. PATENT DOCUMENTS 4,057,399 11/1977 Cole et al. ..... 44/626

4,309,192 1/1982 Kubo et al. ..... 44/626

4,514,912 5/1985 Janusch et al. ..... 44/626

4,769,042 9/1988 Ito et al. ..... 44/626

5,035,721 7/1991 Atherton ..... 44/626

5,256,169 10/1993 Roe ..... 44/626

*Primary Examiner*—Ellen M. McAvoy

*Attorney, Agent, or Firm*—Fisher & Associates

[57] ABSTRACT

A solid fuel in which an oil mixture containing a heavy oil fraction and a solvent fraction is incorporated in fine pores of a porous coal. The improved porous coal is produced by mixing an oil mixture containing a heavy oil fraction and a solvent fraction with a porous coal to obtain a starting slurry, heating the starting slurry to dewater the porous coal, and incorporate, at the same time, the oil mixture into the fine pores of the porous coal and then subjecting the treated slurry to solid-liquid separation.

13 Claims, 4 Drawing Sheets

ADSORPTION ISOTHERMS

ADSORPTION ISOTHERMS

A
B
C
RO
RC
RECYCLE OIL (RYO)
WASTE WATER
TREATED SLURRY
SLUDGE
WET CAKE
M
PC
FILTER
CARRIER
1
2
3
4
5
6
7
8
9
10
11
12
13
14
15
16

SOLID FUEL MADE FROM POROUS COAL AND PRODUCTION PROCESS AND PRODUCTION APPARATUS THEREFORE

BACKGROUND OF THE INVENTION

The present invention concerns a technique for refining a porous coal of low rank into an excellent porous coal for solid fuel and, more in particular, it relates to a technique of efficiently drying a porous coal which is considered have only a of low economical value due to high water content, effectively preventing spontaneous combustion caused upon drying and obtaining a porous coal for solid fuel provided with increased calorific value due to dewatering and deposition of a heavy oil fraction.

DESCRIPTION OF THE RELATED ART

Porous coal intends to contain much high water content, for example, as much as from 30 to 70% by weight due to its high porosity. If the porous coal of such a high water content is to be transported, for example, to industrial areas, it requires a relatively high transportation cost as if water itself were transported, so that it is only viable to use the porous coal near the coal fields. One of typical examples of the porous coal of such high water content includes brown coal.

Although some brown coals have the advantages of low ash and sulfur content, they tend to incorporate high water content because of high porosity. For instance, if the water content exceeds 30%, the transportation cost is increased considerably and the calorific value is reduced commensurate with the water content, so that the brown coal is evaluated as a low rank coal irrespective of the advantages described above. In addition to the brown coal, lignite or sub-bituminous coal also involves similar problems. Description will be made to the brown coal as a typical example of them, but the present invention is applicable to all sorts of porous coals including lignite sub-bituminous coal, etc. Brown coal includes Victorian coal, Norrib Dakota coal and Beluga coal and the present invention is applicable to all kinds of brown coals so long as the they are porous and of high water content irrespective of the place of production.

Considerations have been made so far on the techniques of reducing the water content of the brown coal for utilizing the some as a solid fuel and such techniques are generally classified into:

(1) dry evaporative dewatering method and (2) non-evaporative dewatering method.

As an example of the former method (1), a steam tube drier method has been known, for instance, but it consumes much heat energy for drying and the resultant dry brown coal is very porous. They increase the active surface area and provide a risk of causing spontaneous combustion accident due to adsorption of oxygen to active points and oxidizing reaction, which brings about a practical problem of poor storability and transportability. As the latter method (2), Fleisner process has been known for instance, which can reduce the energy consumption since this is a non-evaporative method, but it requires an increased cost for manufacturing and maintaining a facility suitable to high pressure operation. It also involves difficulty and troublesomeness of conducting a high pressure operation, as well as a problem that waste water formed by dewatering accompanying partial pyrolytic reaction contains a great amount of organic components to deteriorate the water quality and this increases a burden on a waste water processing facility.

Accordingly, it can not be said at present that the technique of utilizing the porous coal as the solid fuel is completely satisfactory as a practical technique.

Known relevant techniques in the prior art for effective utilization of the brown coal, in respect of patent applications which are put to laid open or publication include the followings:

Japanese Patent Publication Sho 60-35959.

A method of producing a dispersed fuel by dewatering under heating a powdery brown coal in the presence of a hydrocarbon oil and then adding a surface active agent. The technique does not provide a solid fuel.

Japanese Patent Publication Sho 62-33271

A method of pelleting a hydrophilic brown coal by utilizing water contained in the brown coal itself as a binder and putting the coal to liquid phase pelletization in an organic liquid such as heavy oil or kerosene.

The technique positively utilizes the water content as a binder for pelleting but it discloses nothing about removal of the water content in pellets by drying.

Japanese Patent Publication Sho 63-61358

A technique of spraying a liquid mixture of aromatic hydrocarbon and asphalt to a previously dewatered brown coal thereby coating the surface of particulate brown coal with an aim of preventing dusting and increasing calorific value.

The technique intends to apply the spray treatment to the previously dewatered dry brown coal and, accordingly, intrusion of the spray liquid is inhibited by air present in the pores of the brown coal. Therefore, only the surface of the particulate brown coal is converted and the liquid does not intrude as far as the inside of the pores and thus making complete coating difficult. Further, there is still a risk of the surface of the pores is exposed subsequently.

Japanese Patent Publication Sho 63-13476

A method of applying carbonization to a part or whole of pulverized brown coal to distill tar and water content (when only some part of pulverized brown coal is carbonized, the remainder is subject to non-evaporative thermal dewatering), mixing the resultant carbonized coal and/or thermal treated coal with water, adding the distilled tar to coagulate the carbonized coal and/or thermal treated coal and further separating water from the coagulated coal particles.

This method essentially aims for dewatering and deashing and involves a problem in view of energy or facility caused by carbonization or non-evaporative thermal dewatering which needs pressure and heating. In particular, since thermal dewatering under pressure and heating results in a great amount of water contaminated with organic materials at high concentration, waste water treatment becomes complicated and difficult.

Japanese Patent Laid Open Sho 61-288889

A method of applying carbonization to a brown coal after heating and drying it to a temperature lower than the temperature for starting pyrolysis, cooling and then coating at least in two steps with a tar of a boiling point more than 250° C. and that of a boiling point in the range of 100° to 250° C., such as those fractionated from tar produced by carbonization.

In this Laid open publication, object of the coating is not a raw coal but much specified carbonized coal. Further, there is also disadvantages that coal has to be put to carbonization in order to obtain a coating tar and that coating has to be applied by two steps separately by fractionating the original tar into the low boiling fraction and the high boiling fraction and using the resultant low boiling fraction and the high boiling fraction separately. In addition, since a gas phase coating method is used, heavy materials with no or extremely low vapor pressure can not be used although they are stable and inexpensive. Accordingly, this method suffers from a restriction in that only the heavy materials having certain level of vapor pressure can be utilized. Further, it requires complicated steps and high energy unit such that a great amount of energy is consumed since the existent dry evaporative method is used in the drying step prior to the carbonization.

International Patent Application Laid-Open Sho 63-503461

A method of impregnating and heating a low rank lump coal pulverized into 0.5 to 1.5 inch in an oil, separating the lamp coal while steams are still released from the coal and, further, removing oils from the wet lump coal. Since the method uses the lamp coal as large as 0.5 to 1.5 inch, it is considered that the adsorption amount of the oil in the pores is insufficient. In addition, an example showing an actual method is impregnating the lump coal, for example, with heated oil, latent heat from the water content occupying most of evaporative separation energy is not recovered. Accordingly, the energy unit is water content coal having a water content as much as 60% only by the sensible heat of the oil lacks in an economical merit.

OBJECT AND SUMMARY OF THE INVENTION

The present invention has been accomplished in view of the foregoing situations and a principal object thereof is to provide a solid fuel from porous coal with no foregoing drawbacks in the prior art. More specifically, the invention provides a solid fuel from porous coal with less worry of spontaneous combustion and thus improved safety during storage or transportation, having an increased calorific value due to dewatering and effective impregnation of a heavy oil fraction.

Another object of the present invention is to provide a process for producing a solid fuel from porous coal free from the foregoing drawbacks in the prior art with respect to heat efficiency, dewatering effect and facility, as well as a production apparatus used for practicing the process.

In a solid fuel made from porous coal in accordance with the present invention, water in the porous coal is sufficiently removed and an oil mixture containing a heavy fraction and a solvent fraction is incorporated in the pores of the porous coal. Since the heavy oil fraction dissolves into the solvent to get a fluidity, it intrudes easily into the pores, can be preferentially adsorbed onto the inner surface thereof and forms a coating membrane thereon to disable active points. The heavy oil fraction can not intrude directly in to micro pores of a particularly small diameter but these micro pores are disabled indirectly by the coating membrane. Micropores having diameter large enough that heavy oil fraction can intrude are disabled directly by the heavy oil fraction. The content of the heavy oil fraction is preferably from 0.5 to 80%, more preferably, from 2 to 15% based on the weight of dry coal i.e. solid fuel excluding water and the oil mixture. The solid fuel made from porous coal in accordance with the present invention includes those in which the heavy oil fraction-containing oil covers not only in the pores but also on the surface.

As a process for producing such a solid fuel from porous coal, there is provided a process which comprises mixing a oil mixture containing a heavy oil fraction and a solvent fraction with a porous coal to obtain a starting slurry, heating the starting slurry to effect dewatering of the porous coal, incorporating and adsorbing, at the same time, the oil mixture containing the heavy oil fraction and the solvent fraction in the pores of the porous coal and then subjecting the thus treated slurry to solid/liquid separation.

For improving the oil recovery rate, the solid content after the solid/liquid separation can further be dried.

The oil mixture obtained through the solid-liquid separation of the treated slurry can be recycled for use as the medium for making the starting slurry, and the oil subsequently recovered by final drying can of course also be used recyclically. Further, the present invention also includes recovery of steams generated during dewatering and use of the recovered steam under elevation of pressure as a heating source.

In accordance with the present invention there is provided an apparatus for practicing the production process described above, comprising a mixing tank for mixing an oil mixture containing a heavy oil fraction and a solvent fraction with a porous coal to prepare a starting slurry, a preheater for preheating the starting slurry, an evaporator for heating the preheated starting slurry to remove water, and solid-liquid separator for recovering coal from the slurry.

The solid-liquid separator may comprise a combination of at least one of settler, centrifuge, filter and expresser. A drier for further drying the solid content after solid-liquid separation may be added to the apparatus.

It is considered that spontaneous combustion of the porous coal is caused when the water content present in the pores of the porous coal is removed by drying, by which active points in the pores are exposed to an external atmosphere, and, especially, an oxygen gas intrudes into the pores and adsorbs on the active points to cause oxidizing reaction, thereby leading to temperature elevation and ignition. Accordingly, in a case of using a drying system in which the surface layer in the fine pores is exposed directly to the external air during or after the completion of the drying step, it is put to a danger of spontaneous combustion during or just after drying and there is a risk of causing spontaneous combustion during storing and handling stages up to the coating operation with the heavy oil fraction. In addition, upon coating, there is also a problem that air remaining in the pores resists to the intrusion of the heavy oil fraction or the like thereby making the heavy oil fraction impossible to impregnate and cover the deep inside of the pores sufficiently and, accordingly, the active points in the pores are exposed as they are to leave a danger of spontaneous combustion.

In view of the above in the present invention, since the oil mixture containing the heavy oil fraction and the solvent fraction is mixed with the porous coal into a slurry, which is then heated, for example, to 100°–250° C., the oil mixture is gradually heated and deposited to the resultant vacant spots in place of the water content after the water content in the pores is evaporated by the heating. In this way, the oil mixture deposits along with the evaporation of the water contents From the pores and, if any steams remain, a negative pressure is formed when they are condensed in a cooling step and the heavy oil fraction-containing oil mixture is vacuum-attracted into the fine pores, so that the surface layer in the fine pores is gradually covered with the heavy oil fraction-containing oil mixture, till substantially the entire region for the openings of the fine pores is filled completely with the heavy oil fraction-containing oil mixture. Moreover, since the heavy fraction in the oil mixture tends to be adsorbed selectively to active points and it is less released once after the deposition, it will be expected that the heavy oil fraction is deposited preferentially to the solvent fraction. In this way, the spontaneous combustion can be prevented by interrupting the surface layer in the fine pores from the air. In addition, since a great amount of the water content is removed while the heavy oil-containing oil. mixture, particularly, the heavy oil fraction preferentially fills the inside of he pores, increase of calorific value for the porous coal can be attained at a reduced cost. The thus obtained high calorie porous coal is safe in that it shows no spontaneous combustion and, thus, a novel and excellent solid fuel made from porous coal is provided.

The heavy oil fraction used in the present invention is a heavy oil fraction such as a vacuum residue not showing a substantial vapor pressure, for example, even at 400° C., or an oil mainly composed of such heavy fraction. Accordingly, if only the heavy oil fraction is used and heated to such an extent as obtaining a fluidity capable of intruding into the pores of the porous coal, the porous coal itself causes pyrolysis at the heating temperature failing to attain the purpose of the present invention. Further, since the heavy oil fraction used in the present invention shows no substantial vapor pressure as described above, it is further difficult to evaporize the same for vapor deposition being carried on a carrier gas. In other words, heavy oil in the liquid state is too viscous to get enough contact with the inside of the coal pores, but on the other hands, heavy oil in the vapor state, which might get better access to the pores, can not be realized due to its low vapor pressure. Accordingly, co-operation with a certain solvent or dispersant is necessary to attain the object.

In view of the above, in the present invention, the heavy oil fraction is first dissolved in the solvent fraction to improve the operability for impregnation and easy slurry making and then used. As the solvent fraction for dispersing the heavy oil fraction, a light oil fraction is preferred in view of the affinity with the heavy oil fraction, handlability of the slurry, easy intrusion into the pores or the like. Considering stability at the water evaporation temperature, it is recommended to use coal derived oil (light oil or heavy oil) having a boiling point of higher than 100° C., preferably, lower than 300° C. in average. Since the coal derived oil often contains hydrophilic oil fractions, it is not preferred a little in that the oil fraction evaporated together with water by dewatering under heating is difficult to be separated from the water content after condensation. Since the heavy oil fraction-containing oil mixture shows such adequate fluidity, use of such a heavy oil fraction-containing oil mixture can promote intrusion into such fine pores, which could not be attained by the heavy oil fraction alone.

The heavy oil fraction-containing oil mixture described above may be obtainable:

(a) from an oil mixture comprising originally both of the heavy oil fraction and the solvent fraction or (b) by mixing the heavy oil fraction and the solvent fraction.

The oil mixture (a) usable herein there can include (1) petroleum derived heavy oil, (2) petroleum derived light oil fraction, kerosene fraction, lubricating oil not yet refined and containing heavy oil fractions (3) coal tar, (4) light oil or kerosene containing impurities of heavy oil fraction after using as a solvent or washing oil and (5) hot oil containing degraded fractions after repeating use. The latter oil mixture (b) usable herein can include (1) petroleum asphalt, natural asphalt, coal derived heavy oil, petroleum or coal derived bottom residue, or a mixture of material mainly composed of them with petroleum derived light oil, kerosene or lubricating oil and (2) the oil mixture (a) described above which is diluted with petroleum derived light oil, kerosene or lubricating oil. The asphalts are used particularly suitably since they are inexpensive and have a property of less detaching from active points once after deposition.

In accordance with the present invention, since the starting porous coal is added to the heavy oil fraction-containing oil mixture prepared as described above to obtain a slurry, and then heated. The water content located in the pores is evaporized and, the heavy oil fraction-containing oil mixture adsorbed onto the vacant sites to replace water. That is, adsorption of the heavy oil fraction-containing oil mixture is conducted by the technique of slurry dewatering. Although slight. amount of steams inevitably remains in the pores even if the slurry dewatering is adopted, since steams are condensed upon cooling in various steps (centrifugation or compression) after the heating, the heavy oil fraction-containing oil mixture is sucked to the deep inside of the pores by a negative pressure caused upon condensation, a higher effect is attained for impregnation adsorption. In this way, since the present invention can provide a porous coal in which the pores as the starting points for spontaneous combustion are sealed to the deep inside thereof with the heavy oil fraction-containing oil mixture, the oil less leaches out when compared with the porous coal in which the coating treatment is applied only at the surface of the porous coal particles, in respect of an identical total deposition amount, and thus a solid fuel of less deposition can be obtained from porous coal.

The content of the heavy oil fraction in the porous coal has no particular restriction and it is preferably from 0.5 to 30% based on the weight of moisture free coal. If it is less than 0.5%, adsorption amount in the pores is insufficient to deteriorate the effect of suppressing the spontaneous combustion. On the other hand, if it exceeds 30%, the cost for the oil is increased to reduce the economical merit.

BRIEF DESCRIPTION OF THE ACCOMPANYING DRAWINGS

These and other features, constitutions, as well as advantages of the present invention will become apparent by reading description of preferred embodiments with reference to the accompanying drawings, wherein.

DETAILED DESCRIPTION OF A PREFERRED EMBODIMENT

Figure 1:
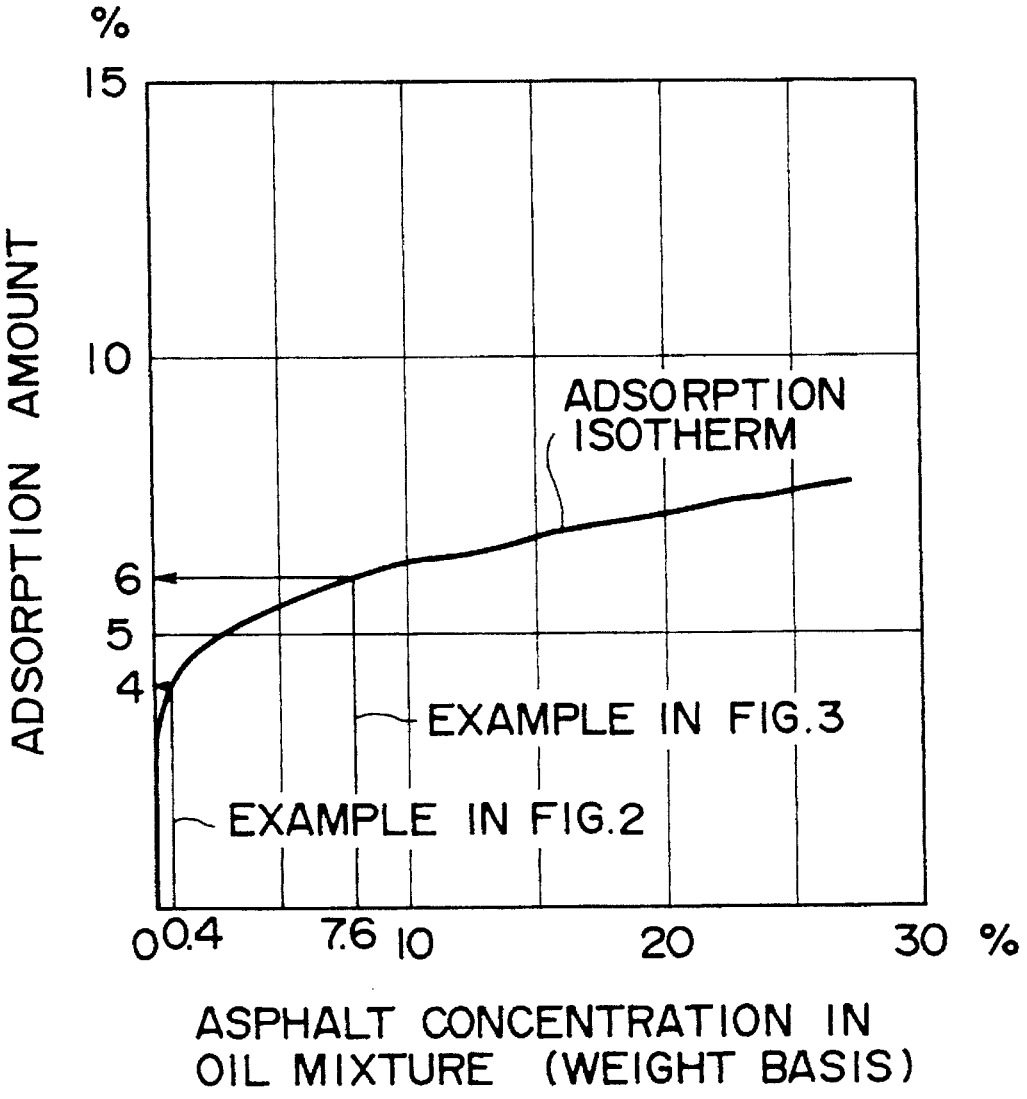
FIG. 1 shows an example of data illustrating adsorption of an asphalt taken place in an evaporation section (adsorption isotherm)

FIG. 1 shows an example of data for the adsorption of an asphalt taken place during slurry dewatering. In the graph, an adsorption isotherm is considerably convexed upwardly and it can be seen that an absorption amount approximate to saturation amount is obtained even at a considerably low concentration and that a sufficient effect can be obtained even if the content of the heavy oil fraction in the oil mixture is small. Two examples of material balance in a case of designing the process utilizing the adsorption characteristic are shown below.

Figure 2:
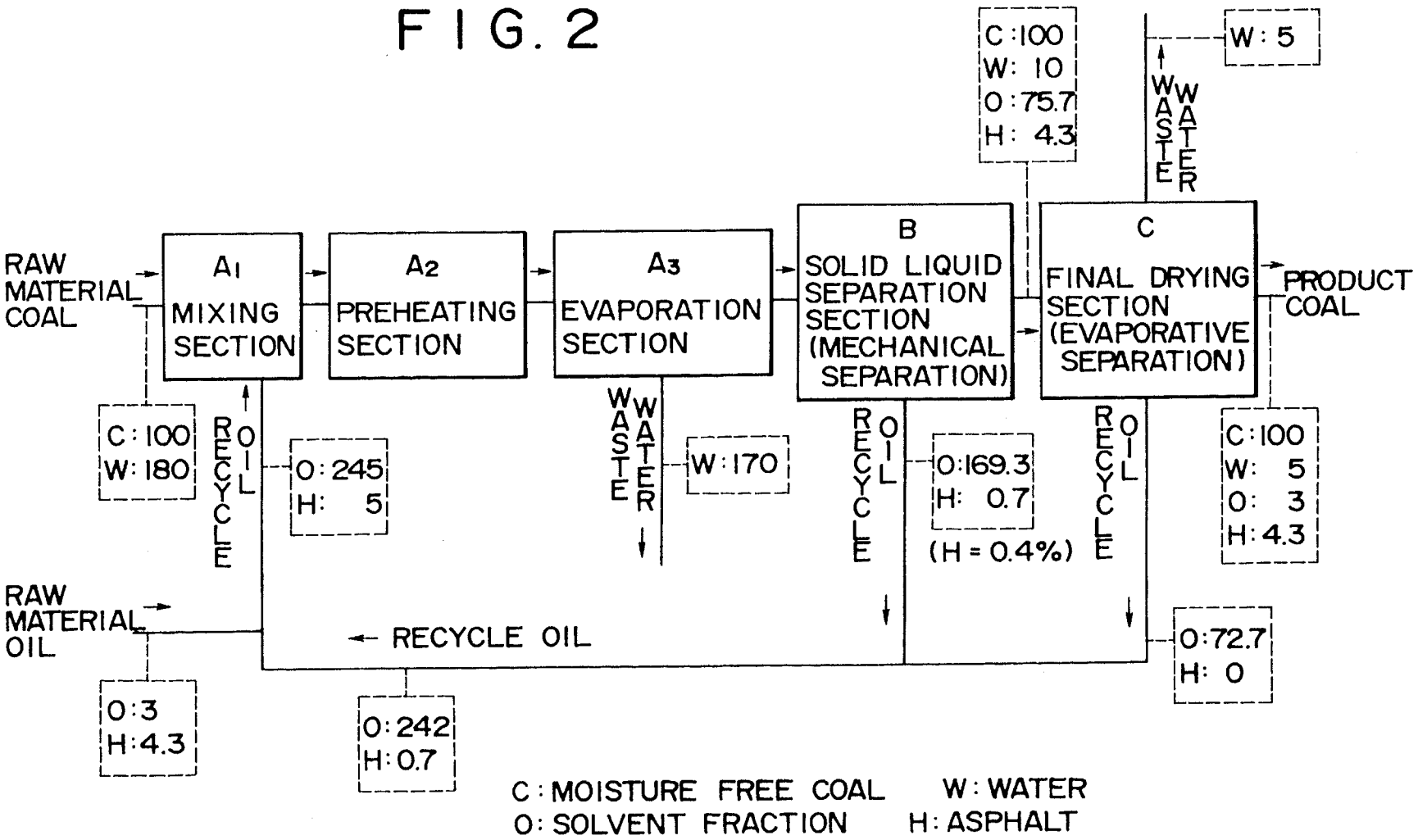
FIG. 2 shows a process flow illustrating a preferred embodiment according to the present invention and an example of the material balance in a case of using an oil mixture containing an asphalt at low concentration.

FIG. 2 shows a production process for solid fuel made from a porous coal in accordance with the present invention illustrating an example of the material balance in a case of operation under such a condition that the concentration of the asphalt in the oil mixture phase is lowered. 280 parts of raw material coal (100 parts of moisture free coal and 180 parts of water content, i.e., 64% of the water content by weight), 250 parts of an oil mixture comprising an asphalt and a solvent fraction (total of 242.7 parts of recycled oil mixture (0.7 parts of the asphalt and 242 parts of a solvent fraction) and 7.3 parts of newly prepared oil mixture (3 parts of an asphalt and 4.3 parts of a solvent fraction)) is supplied to a mixing section A1 to prepare a starting slurry.

The starting slurry is supplied to a preheating section A2, preheated to a temperature near the boiling point of water under an operation pressure, supplied into an evaporation section A3 and dewatered in oil under a condition, for example, at 140° C. and 4 atm. By the treatment, 170 parts of water content is removed and the treated slurry is supplied to a solid-liquid separation section B and put to solid-liquid separation by any of means such as settling, centrifugation, filtration and expression. The separated coal is subsequently dried as necessary and, after further recovery of the oil, is taken out as 112.3 parts of product coal (100 parts of moisture free coal, 5 parts of water content and 7.3 parts of oil mixture (4.3 parts of asphalt and 3 parts of solvent fraction)). On the other hand, 170 parts of the recycled oil mixture separated from the solid-liquid separation section and 72.7 parts of the recycled oil recovered from the drying section, namely, 242.7 parts in total of them are utilized by recycling. As described above, the asphalt is reduced in the composition of the recycled oil mixture as compared with the composition of the newly prepared oil mixture. It is considered that this may be attributable to that adsorption of the asphalt to the porous coal proceeds preferentially.

Figure 3:
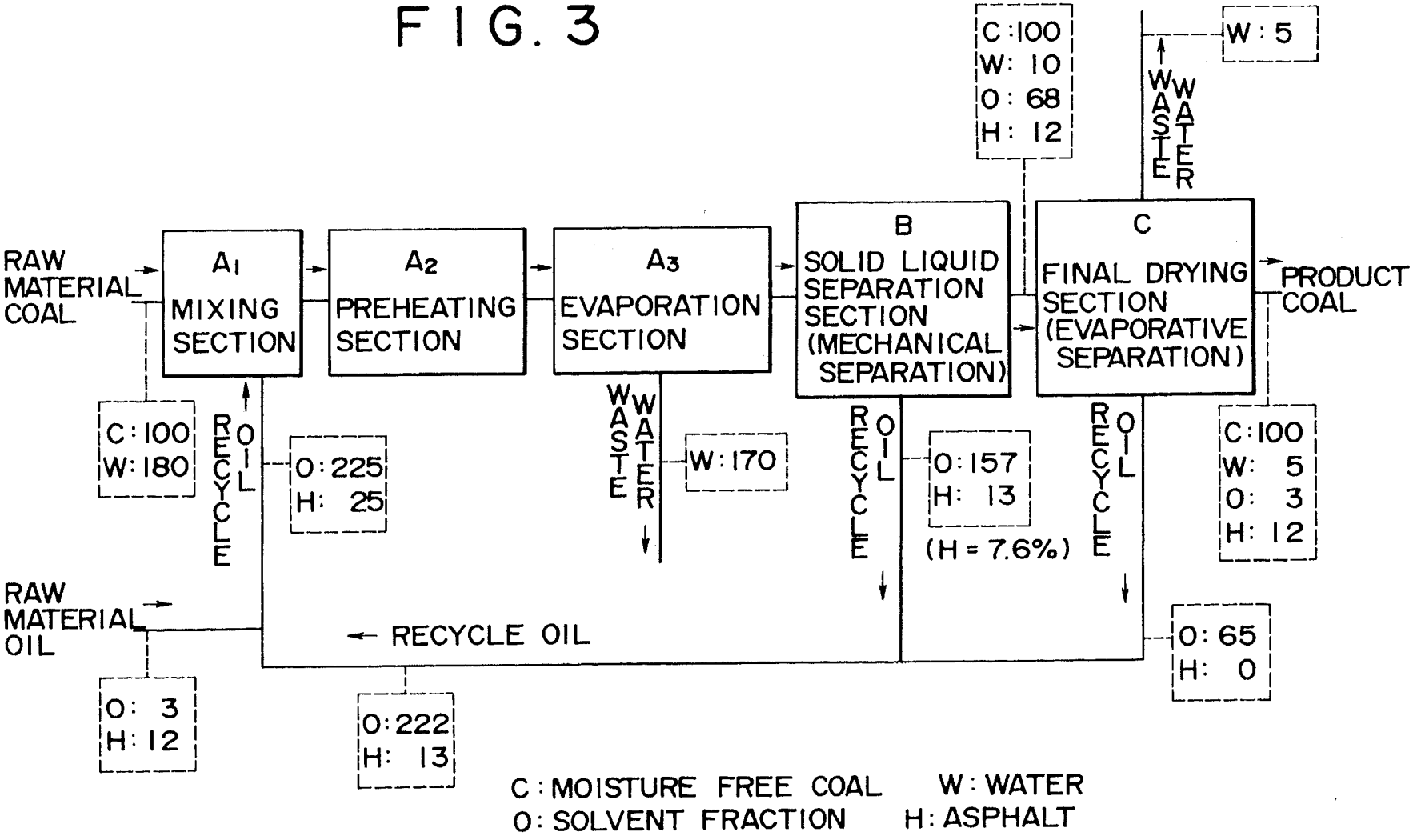
FIG. 3 shows a process Flow illustrating a preferred embodiment according to the present invention and an example of the material balance in a case of using an oil mixture containing an asphalt at high concentration.

FIG. 3 shows an example of the material balance in case of operation under a condition of increasing the concentration of the asphalt in the oil mixture contrary to that in FIG. 2. 280 parts of a raw material coal (100 parts of a moisture free coal, 180 parts of a water content) and 250 parts of an oil mixture comprising an asphalt and a solvent fraction (total for 235 parts of a recycled oil mixture (13 parts of the asphalt and 222 parts of the solvent fraction) and 15 parts of a newly prepared oil mixture (12 parts of the asphalt and 3 parts of the solvent fraction)) is supplied to a mixing section A1 to make a starting slurry.

The starting slurry is supplied to a preheating section A2, preheated to a temperature near the boiling point of water under an operation pressure, supplied into an evaporation section A3 and dewatered in oil under a condition, for example, at 140° C. and 4 atm. By the treatment, 170 parts of the water content is removed and the treated slurry is supplied to a solid-liquid separation section B and put to solid-liquid separation by any of means such as settling, centrifugation, filtration and expression. The separated coal is subsequently dried as necessary and, after further recovery of the oil, is taken out as 120 parts of a product coal (100 parts of a moisture free coal, 5 parts of a water content and 15 parts of an oil mixture (12 parts of the asphalt and 3 parts of solvent fraction)). On the other hand, 170 parts of the recycled oil mixture separated from the solid-liquid separation section and 65 parts of the recycled oil recovered from the drying section, namely, 285 parts in total of them are utilized by recycling.

When the concentration of the asphalt in the oil mixture recovered from the solid-liquid separating section are compared between the examples of the material balance shown in FIG. 2 and FIG. 3, it is about 0.4% by weight for FIG. 2 and about 7.6% by weight for FIG. 3. The adsorption amount each concentration can be calculated from the data shown in FIG. 1, and the adsorption amount of the asphalt in FIG. 2 and FIG. 3 is 4 parts for the example shown in FIG. 2 and 6 parts for example shown. in FIG. 3. On the other hand, the asphalt in the final product is 4.3 parts for the example shown in FIG. 2 and 12 parts for the example shown in FIG. 3 respectively, by which it can be concluded as follows.

(1) In the example of FIG. 2, most of the heavy oil fraction in the final product is adsorbed in the evaporation section A3. In other words, the amount of the heavy oil fraction used is approximate to the minimum required amount for suppressing the spontaneous combustion of the product which causes less wasteful loss. It is a production process suitable to such a case in which the asphalt is expensive or in which impurities in the asphalt give an undesired effect on the specification of the products.

(2) On the contrary, in the case of FIG. 3, the final product contains about 6 parts of the asphalt in addition to the asphalt adsorbed in the evaporation section. This asphalt fraction is derived from the asphalt in the oil mixture that remains in the solid content after solid-liquid separation which is then left still after the final drying due to its low vapor pressure. Different from the asphalt adsorbed in the evaporation section, since the oil mixture left after the solid-liquid separation is present to the outer surface of the solid content or the inner surface of the pore in the form having no particular selectivity, it can be considered that the heavy fraction oil remaining after evaporation is present uniformly to the inner and the outer surfaces thereof. Asphalt is generally used as a preferable binder upon molding such as briquetting and the final product in the example of FIG. 3 can be said suitable not only to a case in which the asphalt is inexpensive but also to a case of molding the product further. Considering the difficulty in uniformly and thinly coating an asphalt having high viscosity and scarcely having vapor pressure to a porous powder, it can be seen that the production process is extremely effective for the molding of the product.

For waste water shown in FIGS. 2 and 3, an example of data on water quality for 170 parts of waste water from the evaporation section A3 that constitute most portion of the entire waste water in view of the quantity is shown in Table 1 in comparison with that for the waste water from the Fleisner process described above. It can be seen that the degree of organic contamination of waste water is reduced extremely.

Further, Table 2 shows an example of data examining the spontaneous combustion of the final product. It can be seen that the spontaneous combustion of the product can effectively the suppressed by the presence of the oil mixture containing the asphalt.

TABLE 1

| | Nature of Waste Water | |
|---|---|---|
| Process | COD (ppm) (1) | BOD (ppm) (2) |
| Fleisner process (3) (processing temperature: 250° C.) | 22600 | 5900 |
| Slurry Dewatering (4) | 108 | 114 |

TABLE 1-continued

| Process | Nature of Waste Water COD (ppm) (1) | BOD (ppm) (2) |
|---|---|---|
| (petroleum derived solvent used) | | |

(1) Chemical oxyen demand
(2) Biochemical oxygen demand
(3) Literature value: Stanmore, B., D. N. Baria and L.E. Paulson: "STEAM DRYING OF LIGNITE: A REVIEW OF PROCESSES AND PERFORMANCE" p 25
(4) Experimental values in the process according to the present invention

TABLE 2

Test for Spontaneous Combustion
Test Apparatus: Spontaneous combustion test apparatus (Model SIT-I) manufactured by Shimazu Seisakusho Co., LTD
Initial temperature: 100° C.
Atmosphere: Air 20 ml/min

| Kind of coal | Heat generation initiation time | Judgment for spontaneous combustion |
|---|---|---|
| Dry brown coal | 13.7 hr | presence |
| Product coal(1) | not generated heat for 1 week | absence |
| Product coal(2) | not generated heat for 1 week | absence |

(1) Product containing 12% asphalt and 2% kerosene (each based on moisture free coal by weight)
(2) Product containing 12% asphalt and 10% kerosene (each based on moisture free coal by weight)
(3) Those causing no heat generation for more than one week in this apparatus are regarded to have no spontaneous combustion property Description will be made to the outline of an apparatus for producing a solid fuel from porous coal in accordance with the present invention with reference to FIG. 4.

Figure 4:
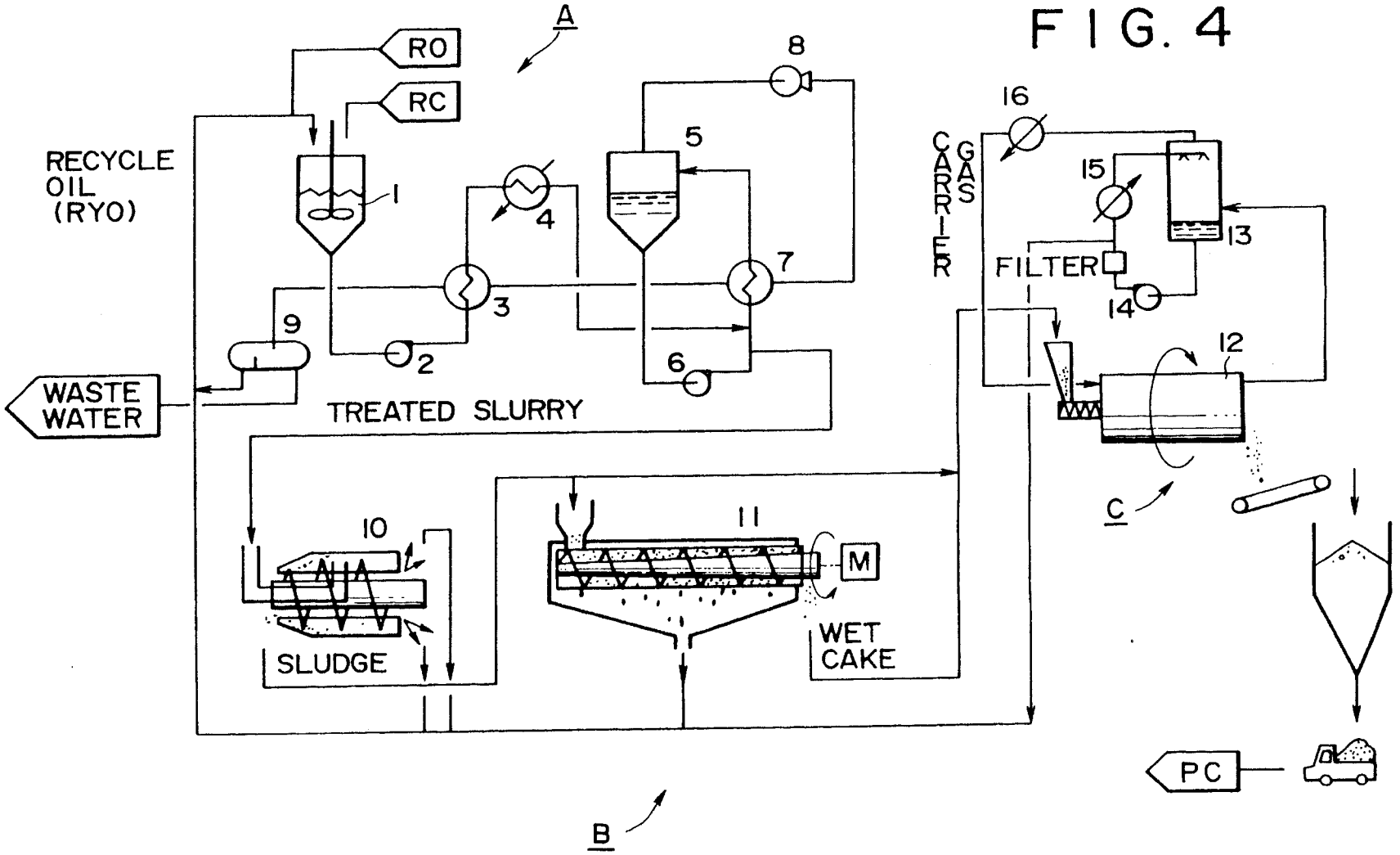
FIG. 4 is a view schematically illustrating a production apparatus in a preferred embodiment according to the present invention.

In FIG. 4, are shown a starting slurry dewatering section A, a solid-liquid separation section B and a final drying section C respectively. Each of the sections A, B and C will be explained successively.

At first, the section A (slurry dewatering section) mainly comprises a mixing tank 1 and an evaporator 7 in which pulverized raw material porous coal RC and a raw material oil RO are charged in the mixing tank 1, and undergo stirring to make a starting slurry. In the figure, it is adapted such that an oil mixture separated in the solid-liquid separation section B and the final drying section C can be used recyclically as a recycled oil RYO. Accordingly, although it is necessary, at the start of the operation of this apparatus, to charge a considerably great amount of the raw material oil RO. However, as it enters continuous operation, the amount of the raw material oil RO to supplement the amount carried out by a porous product coal PC will suffice as the charging amount.

Referring to the amount of the asphalt to be used, since adsorption of the asphalt proceeds preferentially upon adsorption to the raw material porous coal RC to decrease the amount of the asphalt in the recycled oil mixture, it is recommended to always control the amount of the asphalt in the raw material oil RO to 0.5–30% of the weight of dry porous coal(dry basis, i.e. moisture freed porous coal) to be charged into the mixing tank 1, with a view point of ensuring the adsorption amount into the pores of the raw material porous coal RC. On the other hand, referring to the solvent fraction such as a light oil or a heavy oil for forming the starting slurry, an amount for supplementing the amount carried out by the porous product coal PC may suffice and it may be less than 30% by weight based on the raw material porous coal RC(dry basis). It is recommended that the oil and raw material porous coal be mixed with in the weight ratio in the range of 1:1 to 20:1 and preferably in the weight ratio in the range of 1:1 to 10:1 (dry basis).

The starting slurry formed under sufficient stirring and mixing in the mixing tank 1 is supplied by way of a pump 2 and preheater 3, 4 into an evaporator 7, in which it is heated under pressure at 1–40 atm (preferably, 2–15 atm) at a temperature from 100° to 250° C. (preferably 120 to 200) and undergoes slurry dewatering. At the same time, the oil mixture containing the asphalt and the solvent fraction intrudes and is adsorbed to the pores of the porous coal. For instance, in an example carried out by using a raw brown coal at a water content of 65% by weight and using an oil mixture containing an asphalt three times as much as the moisture free brown coal by weight ratio, the water content could be reduced to less than 10% by weight by slurry dewatering. If the water content can be reduced to less than 30% by weight, preferably, 20% by weight, it can be considered that the aimed subject can be attained in view of the transportation cost. The lower limits for the pressure and the temperature are determined such that the operation pressure in the process is not reduced to a negative pressure, whereas upper limits for the pressure and the temperature are determined to provide such a condition as the raw material coal does not undergo pyrolysis.

The porous coal slurry having thus adsorbing the oil mixture is transferred to the vapor liquid separator 5, separated with steams, then withdrawn from the bottom and then sent by a pump 6 to a centrifuge 10. A portion of the slurry is branched at the midway of the transportation line, the temperature is elevated by passing the slurry through an evaporator 7 and then it is returned by the vapor liquid separator 5. On the other hand, steam generated by evaporator 7 is sent to compressor 8 via vapor liquid separator 5, where it is compressed to elevate its pressure. The slurry is heated in the evaporator 7 by this compressed steam to conduct slurry dewatering. The compressed steam is successively transported to the preheater 3, utilized as a preheating source for the starting slurry and then put to oil-water separation in an oil-water separator 9 and water is discarded. The amount of the oil recovered in the oil-water separation is not so much but it is returned to the mixing tank 1 for reuse.

Then, in the section B (solid-liquid separation section), condensation is at first carried out by a centrifuge 10 and, expression is further conducted by a screw press 11. The porous coal undergoing slurry dewatering has a merit of having good solid-liquid separatability. The process may be conducted using a the centrifuge, or the screw press. Also settling separation may be adopted instead of the centrifugal separation, and similarly vacuum filtration may be adopted instead of expression. The oil obtained by solid-liquid separation is returned as a recycled oil to the section A, while the wet solid component is sent to the final drying section C, undergoes final drying by a drier 12 through which a carrier gas is blown and is then recovered as a porous product coal PC. A fluidized bed system or a rotary dried system is recommended for the drying. The oil delivered and separated therefrom on the carrier gas is sent to a condenser 13, recovered as an oil component and then returned as the recycled oil to the section A.

In accordance with the present invention having been constituted as described above, effective slurry dewatering can be conducted while restricting the installation cost and increase of the energy consumption, and the asphalt can be penetrated and adsorbed sufficiently to the pores of the porous coal. The thus obtained porous coal for solid fuel is sufficiently dewatered and provided with increased calorific value by preferential adsorption of the asphalt, as well as reduced for the spontaneous combustion greatly to be enhanced for the transportability and the storability. In addition, since the asphalt is less leaching, a porous coal with less adherence can be obtained. Further, depending on the operation conditions, a molded coal raw material with controlled adherence can be obtained by leaving an adequate amount of the asphalt as a binder uniformly over the surface of the product coal. Accordingly, the porous product coal can be utilized as a finely powdered coal fuel or molded (lumpy) coal fuel such as in general boilers, power stations and iron making factory. In addition, since the quality of waste water is preferred, it does not excessively increase a burden on water treatment also in view of the production process.

What is claimed is:

1. A solid fuel comprising:

a porous coal; and an oil mixture comprising a heavy oil fraction impregnated in fine pores of said porous coal and a solvent fraction dispersing the heavy oil fraction for impregnating the fine pores of said porous coal.

2. The solid fuel of claim 1, wherein said heavy oil fraction impregnated in said porous coal constitutes 0.5 to 30% of the weight of said solid fuel.

3. The solid fuel as defined in claim 1, wherein the porous coal is brown coal and the solvent fraction comprises a petroleum derived oil having a boiling point higher than 100° C.

4. A process for producing a solid fuel from porous coal, comprising the steps of:

providing porous coal;

providing an oil mixture containing a heavy oil fraction for impregnating the porous coal and a solvent fraction for dispersing the heavy oil fraction in impregnating the porous coal;

mixing the oil mixture with the porous coal to obtain a starting slurry;

heating the starting slurry to effect dewatering of the porous coal;

impregnating fine pores of the porous coal with the heavy oil fraction and the solvent fraction during said dewatering of the porous coal;

evaporating water removed from the porous coal during said dewatering; and subjecting the treated slurry to solid-liquid separation.

5. The process for producing a solid fuel as defined in claim 4, wherein the starting slurry is prepared by mixing said oil mixture and said porous coal in the ratio in the range of 1:1 to 20:1 by weight.

6. The process for producing a solid fuel as defined in claim 4, wherein starting slurry is heated to the temperature in the range of 100° to 250° C.

7. The process for producing a solid fuel as defined in claim 4, further comprising the steps of drying the solid separated in the solid-liquid separation step.

8. The process for producing a solid fuel as defined in claim 4, wherein the oil mixture containing the heavy oil fraction and the solvent fraction recovered during solid-liquid separation of the treated slurry is recycled for use as the medium for making slurry.

9. The process for producing a solid fuel as defined in claim 4, wherein steams generated during dewatering are recovered and subject to an elevated pressure, and are used as a heat source for the starting slurry.

10. The process for producing a solid fuel as defined in claim 4, wherein said step of subjecting the treated slurry to solid-liquid separation includes using at least one of settling, centrifugal separation, filtration, and expression to effect said solid-liquid separation.

11. An apparatus for producing a solid fuel from porous coal, comprising:

a mixing tank for mixing porous coal with a heavy oil fraction for impregnating fine pores of said porous coal and a solvent fraction for dispersing said heat oil fraction to impregnate the fine pores of the porous coal and thereby prepare a starting slurry;

a preheater for preheating the starting slurry;

an evaporator for heating the preheated starting slurry to remove water and thereby produce a dewatered slurry; and a solid-liquid separator for solid-liquid separation of the dewatered slurry.

12. The apparatus for producing a solid fuel as defined in claim 11, wherein the solid-liquid separator comprises at least one of a settler, a centrifuge, a filter and an expresser.

13. The apparatus for producing a solid fuel as defined in claim 11, further comprising a drier for drying the solid separated in the solid-liquid separation.

* * * * *